United States Patent [19]

Smith

[11] 4,150,181

[45] Apr. 17, 1979

[54] FIXING METHOD USING POLYSILOXANE-FLUOROCARBON BLENDS AS RELEASE AGENTS

[75] Inventor: Donald B. Smith, Penfield, N.Y.

[73] Assignee: Xerox Corporation, Stamford, Conn.

[21] Appl. No.: 812,293

[22] Filed: Jul. 1, 1977

[51] Int. Cl.[2] ..... G03G 13/20

[52] U.S. Cl. ..... 427/444; 427/22; 427/194; 427/374 C; 432/60

[58] Field of Search ..... 427/22, 194, 197, 374 C, 427/444; 118/60; 432/60, 228

[56] References Cited

U.S. PATENT DOCUMENTS

| | | | |
|---|---|---|---|
| 3,661,831 | 5/1972 | Fang | 260/32.8 A |
| 3,669,707 | 6/1972 | Donnelly et al. | 427/22 |
| 3,810,776 | 5/1974 | Banks et al. | 427/194 |
| 3,849,062 | 11/1974 | Thettu et al. | 432/60 |
| 3,874,894 | 4/1975 | Pedersen | 427/22 |
| 3,884,181 | 5/1975 | Thettu | 432/60 |
| 3,934,547 | 1/1976 | Jelfo et al. | 118/60 |
| 3,937,919 | 2/1976 | Clerx et al. | 432/60 |
| 3,973,844 | 8/1976 | McCarroll | 432/60 |
| 4,029,827 | 6/1977 | Imperial et al. | 427/22 |
| 4,075,362 | 2/1978 | Concannon | 427/22 |

FOREIGN PATENT DOCUMENTS

| | | | |
|---|---|---|---|
| 2542407 | 4/1976 | Fed. Rep. of Germany | 427/22 |

*Primary Examiner*—Michael F. Esposito
*Assistant Examiner*—Stuart D. Frenkel
*Attorney, Agent, or Firm*—James J. Ralabate; Ernest F. Chapman

[57] ABSTRACT

A contact fuser assembly and method for preventing toner offset on a heated fuser member in an electrostatic reproducing apparatus includes a base member coated with a solid, abrasion resistant material such as polyimide, poly (amide-imides), poly (imide-esters), polysulfone and aromatic polyamides. The fuser member is coated with a thin layer of polysiloxane fluid containing low molecular weight fluorocarbon. Toner offset on the heated fuser member is prevented by applying the polysiloxane fluid containing fluorocarbon to the solid, abrasion resistant surface of the fuser member.

15 Claims, 3 Drawing Figures

FIXING METHOD USING POLYSILOXANE-FLUOROCARBON BLENDS AS RELEASE AGENTS

BACKGROUND OF THE INVENTION

This invention relates generally to xerographic copying methods and apparatus, and more particularly, it relates to the fixing of particulate thermoplastic toner by direct contact with the surface of a fusing member having a novel release surface.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support member, such as a sheet of plain paper, with subsequent affixing of the image thereto.

In order to affix or fuse electroscopic toner material onto a support member permanently by heat, it is necessary to elevate the temperature of the toner material to a point at which the constituents of the toner material coalesce and become tacky. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrophotographic recording arts, the use of thermal energy for fixing toner images onto a support member is old and well known.

One approach to thermal fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the fuser roll thereby to affect heating of the toner images within the nip. By controlling the heat transferred to the toner, virtually no offset of the toner particles from the copy sheet to the fuser roll is experienced under normal conditions. This is because the heat applied to the surface of the roller is insufficient to raise the temperature of the surface of the roller above the "hot offset" temperature of the toner at which temperature the toner particles in the image areas of the toner liquify and cause a splitting action in the molten toner resulting in "hot offset". Splitting occurs when the cohesive forces holding the viscous toner mass together are less than the adhesive forces tending to offset it to a contacting surface such as a fuser roll.

Occasionally, however, toner particles will be offset to the fuser roll by an insufficient application of heat to the surface thereof (i.e. "cold" offsetting); by imperfections in the properties of the surface of the roll; or by the toner particles insufficiently adhering to the copy sheet by the electrostatic forces which normally hold them. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the reproducing apparatus.

One arrangement for minimizing the foregoing problems, particularly that which is commonly referred to as "offsetting", has been to provide a fuser roll with an outer surface or covering of polytetrafluoroethylene, known by the trade name "Teflon" to which a release agent such as silicone oil is applied, the thickness of the Teflon being on the order of about 1–5 mils and the thickness of the oil being less than 1 micron. Silicone oil, polydimethylsiloxane, which possesses a relatively low surface energy, has been found to be a material that is suitable for use in the heated fuser roll environment where Teflon constitutes the outer surface of the fuser roll. In practice, a thin layer of silicone oil is applied to the surface of the heated roll to form an interface between the roll surface and the toner images carried on the support material. Thus, a low surface energy layer is presented to the toner as it passes through the fuser nip and thereby prevents toner from offsetting to the fuser roll surface.

A fuser roll construction of the type described above is fabricated by applying in any suitable manner a solid layer of abhesive material to a rigid core or substrate, such as the solid Teflon outer surface or covering of the aforementioned arrangement. In U.S. Pat. No. 3,934,547 a solid low surface energy coating is applied to a fuser member core by contacting the core with a bar of low surface energy material and a low viscosity release agent is applied to the low surface energy coating to facilitate release of support sheets from the heated core. Exemplary of the apparatus disclosed and claimed in U.S. Pat. No. 3,934,547 is a copper core coated with a fluorocarbon telomer such as Vydax 1000 manufactured by E. I. duPont, and a 60,000 cp silicone oil is applied thereto as a thin layer. The Vydax 1000, a trademark of E. I. duPont, is applied to the copper core from a solid bar of material biased to contact the surface of the copper core. U.S. Pat. No. 3,934,547 is incorporated herein by reference and claims an apparatus comprising a heated fuser structure having a thermally conductive core; means for applying a solid low surface energy material; means for applying a low viscosity release agent to the low surface energy coating; and a deformable backup member forming a nip with the core member. Although this prior art technique reduces the damage from accidental gouging by stripper fingers conventionally employed in such systems and reduces the problems of wear and degradation due to continued operation at elevated temperatures, it is desirable to provide fuser members having abrasion resistant surfaces and good release properties.

OBJECTS OF THE INVENTION

It is the principal object of this invention to provide a new and improved fusing process and device for use in fixing toner images to a support member.

Another object of this invention is to provide a fusing device having an improved abrasion resistant surface.

Another object of this invention is to provide a fusing process in a fusing device having an abrasion resistant surface which releases heated or molten toner.

It is another object of this invention to provide a fusing process and device for use in fixing toner images to a support member wherein a new and novel release agent is applied to an abrasion resistant surface on a fuser member.

Other objects and advantages of the present invention will become apparent when read in conjunction with the accompanying drawings and specification.

SUMMARY OF THE INVENTION

The above-cited objects of the present invention are accomplished by applying a mixture or blend of a polysiloxane fluid and a fluorocarbon to the surface of a fuser member having an abrasion resistant surface material selected from the group consisting of polyimide, polyamide-imide, polyimide ester, aromatic polyamide and polysulfone. A support sheet bearing a toner image contacts the solid, abrasion resistant material having the release agent thereon for a time and at a temperature sufficient to permit heating and fusion of the toner image to the support sheet. The support sheet is then separated from the release agent covered surface of the abrasion resistant material and the heated toner separates from the surface of the abrasion resistant material and upon cooling is fused to the support sheet.

The release agent blend or mixture of a polysiloxane fluid and a fluorocarbon is applied to the solid-abrasion resistant surface material of the fuser member in an amount sufficient to cover the surface of the fuser member with at least a continuous, low surface energy film of the release agent to provide the fuser member with a surface which releases toner heated by the fuser member and prevents the toner from contacting the surface of the fuser member. The release agent may be applied to the surface of the fuser member in thicknesses ranging from submicron to several microns to constitute a minimal barrier to heat transfer.

As used herein, polysiloxane fluid refers to any fluid generally used as a release agent and having a siloxane backbone. Thus, polysiloxane fluid may be conventional silicone oil, such as polydimethylsiloxane, or it may be a polyalkylsiloxane having functional groups or other substituted groups thereon, or it may be mixtures of the foregoing.

In accordance with the present invention there is also described an apparatus for fusing toner images to support sheets wherein the apparatus comprises a heated fuser structure having a solid, abrasion resistant surface; means for applying a release agent to the abrasion resistant surface for facilitating release of the support sheets from the abrasion resistant surface; and a pressure member for forming a nip with the heated fuser structure so that the support sheets having toner images thereon contact the release agent on the heated fuser member. The solid, abrasion resistant surface is a material selected from the group consiting of polyimide, polyamide-imide, polyimide ester, aromatic polyamide, and polysulfone. The release agent is a mixture of a polysiloxane fluid, such as conventional silicone oil, and a fluorocarbon.

DESCRIPTION OF THE PREFERRED EMBODIMENT

Figure 1:
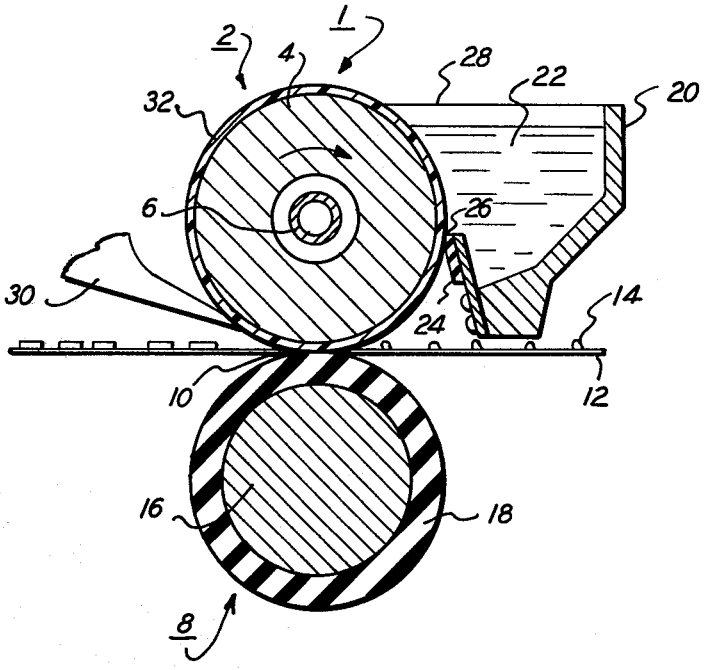
FIG. 1 is a side elevational view of a typical fuser system for a xerographic reproducing apparatus.

The fuser embodiments and release agents of the present invention may be used in an automatic xerographic reproducing machine, such as the automatic xerographic reproducing machine described in U.S. Pat. 3,937,637, said patent being incorporated herein by reference. Therein is illustrated a reproducing machine which employs an image recording drum-like member, the outer periphery of which is coated with a suitable photoconductive material. One type of photoconductive material is disclosed in U.S. Pat. No. 2,970,906 issued to Bixby in 1961. The photoconductive drum is suitably journaled for rotation within a machine frame by means of a shaft which rotates to bring the image retaining surface thereon past a plurality of xerographic processing stations. Suitable drive means are provided to power and coordinate the motion of the various cooperating machine components whereby a faithful reproduction of the original input scene information is recorded upon a sheet of final support material such as paper or the like.

Since the practice of xerography is well known in the art, the various processing stations for producing a copy of an original are represented as Stations A to E. Initially, the drum moves the photoconductive surface through a charging station A. At charging station A an electrostatic charge is placed uniformly over the photoconductive surface of the drum preparatory to imaging. The charging may be provided by a corona generating device of a type described in U.S. Pat. No. 2,836,725 issued to Vyverberg in 1958.

Thereafter, the drum is rotated to exposure station B where the charged photoconductive surface is exposed to a light image of the original input scene information, whereby the charge is selectively dissipated in the light exposed regions to record the original input scene in the form of a latent electrostatic image. A suitable exposure system may be provided by one skilled in the art.

After exposure, the photoconductive drum rotates the electrostatic latent image recorded on the photoconductive surface to development station C, wherein a conventional developer mix is applied to the photoconductive surface rendering the latent image visible. A suitable development station may include a magnetic brush development system utilizing a magnetizable developer mix having carrier granules and toner comprising electrophotographic resin plus colorant from dyes or pigments. A developer mix is continually brought through a directional flux field to form a brush thereof. The electrostatic latent image recorded on the photoconductive surface is developed by bringing the brush of developer mix into contact therewith. The developed image on the photoconductive surface is then brought into contact with a sheet of final support material within a transfer station D and the toner image is transferred from the photoconductive surface to the contacting side of a final support sheet. The final support material may be plain paper, gummed labels, transparencies such as polycarbonate, polysulfone and polyester film, etc. as desired.

After the toner image has been transferred to the sheet of final support material, the sheet with the image thereon is advanced to a suitable fuser assembly which fuses the transfer powder image thereto. After the fusing process, the final support material is advanced by a series of rolls to a copy paper tray for subsequent removal therefrom by a machine operator.

Although most of the toner powder is transferred to the final support material, some residual toner remains on the photoconductive surface after the transfer of the toner powder image to the final support material. The residual toner particles remaining on the photoconductive surface after the transfer operation are removed from the drum as it moves through cleaning station E. Here the residual toner particles may first be brought under the influence of a cleaning corona generating device adapted to neutralize the electrostatic charge remaining on the toner particles. The neutralized toner particles are then mechanically cleaned from the photoconductive surface by conventional means as for example, the use of a resiliently biased knife blade. Other cleaning modes may be used at cleaning station E as desired by one skilled in the art.

It is believed that the foregoing description is sufficient for purposes of the present application to illustrate the general operation of an automatic xerographic copier which can embody the teachings of the present invention.

Fuser assemblies include cylindrical rolls, flat plates, curved plates, belts and the like having at least an outer surface of a solid abrasion resistant material selected from the group consisting of polyimide, polyamide-imide, polyimide ester, aromatic polyamide and polysulfone, however, for ease of description, the general details of which are applicable to all fuser members, emphasis herein is directed to a fuser assembly having a roll structure as a fuser member. The method of providing the necessary heat is not critical in the use of the fuser rolls and release agents of this invention, and the fuser members can be heated by internal means, external means or both, all heating means being well known in the art for providing sufficient heat to fuse toner to its substrate.

The fuser assembly may further comprise a backup roll structure which cooperates with the fuser roll structure to form a nip through which a copy paper or substrate passes such that toner images thereon contact the fuser roll structure. The backup roll structure may comprise any suitable construction, for example, a steel cylinder, but preferably comprises a rigid steel core having a Viton elastomer surface or layer thereon. A preferred backup roll has a core approximately 1.8 inches in diameter with a 0.1 inch cover or layer structure of silicone rubber covered with a thin sleeve of a fluorocarbon material such as FEP. The specific dimensions of the members making up the backup roll will be dictated by the requirements of the particular copying apparatus wherein the fuser assembly is employed, the dimensions being greater or less depending upon the process speed of the machine.

Means (not shown) for applying a loading force in a conventional manner to the fuser assembly serves to create nip pressures on the order of 15 to 150 psi average. The durometer of the backup roll is chosen such that "dwell times" of 5 to 100 milliseconds can be obtained with loading forces within the aforementioned range of pressures. Dwell time is proportional to the ratio of the nip length to the surface speed of the rolls. For a given angular velocity the surface speeds will vary depending upon the diameter of the rolls. For example, with a 2 inch fuser roll speeds of 0 to 30 inches per second are attainable and for a 3 inch fuser roll speeds of 0 to 45 inches per second have been attained. Accordingly, it can be seen that the aforementioned dwell time can be obtained by varying one or the other or both of the dwell time relationships. Durometers of 20–90 Shore A have been found to provide satisfactory results.

A preferred fuser assembly having the features of the present invention is illustrated in FIG. 1.

In FIG. 1, the numeral 1 designates a fuser assembly comprising heated roll structure 2, backup roll 8 and sump 20. Heated roll 2 includes a hollow cylinder 4 having a suitable heating element 6 disposed in a portion thereof which is coextensive with the cylinder and a surface layer or coating 32 of solid, abrasion resistant material.

Backup roll 8 cooperates with coated roll structure or hollow substrate 2 to form a nip 10 through which a copy paper or other substrate 12 passes such that toner images 14 thereon contact heated roll 2. As shown in FIG. 1, the backup roll 8 has a rigid steel core 16 with a sleeved elastomer surface layer 18 thereon.

Cylinder 4 may be fabricated of metal such as anodized aluminum, aluminum and alloys thereof, steel, nickel and alloys thereof, copper, and the like as described above or glass. When the fuser assembly comprises a base member having a configuration other than a roll, the base member whether flat, curved, or the like, can also be made of metals or glass. In those embodiments having heat generated inside the base member, the most preferred base members are those having high thermal conductivity.

The working surface 32 of fuser roll 2 comprises a layer or coating of solid, abrasion resistant material deposited on cylinder 4. Surface layer 32 may be deposited on cylinder 4 or other suitable substrate by any well known technique such as shrink fitting or glueing a sleeve of the material thereon, spray coating a powder or dispersion of the material thereon and baking, extruding hot melt material thereon, applying one or more films of the material in solution thereto and evaporating the solvent, and the like.

There is also provided in accordance with the embodiment shown in FIG. 1, sump 20 for containing one of the designated release agents 22 comprising a blend of polysiloxane fluid and fluorocarbon.

In the embodiment shown in FIG. 1 for applying release material 22 to surface 32 of heated roll 2, a metering blade 24 preferably of conventional non-swelling rubber is mounted to sump 20 by conventional means such that an edge 26 thereof contacts the solid substrate 2 of the fuser roll structure to serve as a metering means for applying release material 22 to the fuser roll in its liquid or fluid state. By using such a metering blade a layer of release fluid 22 can be applied to surface 32 of heated roll 2 in controlled thicknesses ranging from submicron thicknesses to thicknesses of several microns of the release fluid. Thus, by metering device 24, about 0.1 to 0.5 micron or greater thicknesses of release fluid can be applied to solid, abrasion resistant layer 32. In the embodiment shown, a pair of end seals 28, for example, of sponge rubber, are provided to contain the release material 22 in sump 20. One or more stripper fingers 30 may be provided for insuring removal of the substrate 12 from surface 32. In one of the preferred embodiments, thermoplastic resin toner may be fused to other substrates such as polymeric films, metals and other substrates by the fuser members and process of the present invention.

The embodiment described above in FIG. 1 is merely one of the preferred means for applying a layer of the described release agents or materials in an amount sufficient to cover solid, abrasion resistant surface 32 with at least a continuous, low surface energy film of the fluid release agent or material to provide the fuser member with a surface which releases toner heated by the fuser member. Other means for applying the release fluid or agent 22 which is abhesive, to heat fusible electroscopic toner at elevated temperatures, comprise means which spray a layer of the release fluid upon the fuser surface, a pad or sponge-like material which pads a coating of the release fluid on the surface of the fuser member, a wick which contacts the surface of the fuser member to provide a film or layer of the release material, extruding means which extrude a minute film of the release material on the fuser member, a brush or bristle having the release fluid on the surfaces of the bristles or brush materials, fluid soaked rolls, sponges or wicks and the like.

Figure 2:
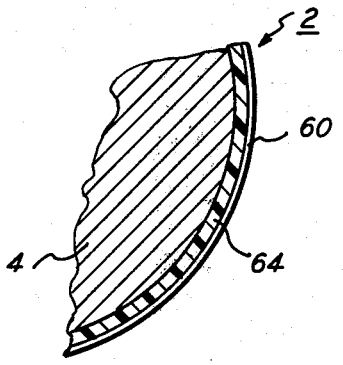
FIG. 2 is a fragmentary view of a typical fuser member of the present invention.
Figure 3:
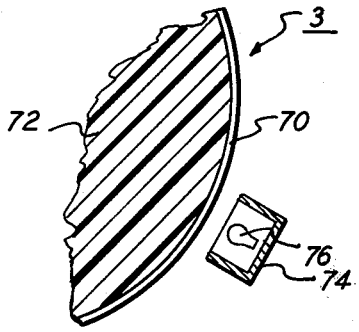
FIG. 3 is a fragmentary view of another typical fuser member of the present invention showing an external source of heat.

The fuser member for an electrostatic reproducing apparatus resulting from applying the blend of polysiloxane fluid and fluorocarbon to the surface of the solid, abrasion resistant material of the fuser member, is shown in FIGS. 2 and 3. The fuser member shown in FIG. 2 is magnified many times over the member shown in FIG. 1 in order to show the thin layers on the fuser member surface. In FIG. 2, the solid portion of the heated roll is designated by numeral 4. A release layer of fluid is designated by numeral 60 and solid, abrasion resistant coating or layer is designated by numeral 64. Thus, there is described a fuser member having a solid substrate 4, a release layer of polysiloxane fluid containing fluorocarbon, 60, which is abhesive to electroscopic toner and solid, abrasion resistant layer 64 which prevents the electroscopic toner (not shown) from contacting solid substrate 4, layer 64 comprising a polyimide, a poly (amide-imide), a poly (imide ester), an aromatic polyamide or a polysulfone.

The fuser member shown in FIG. 3 is also magnified to show the layer of release agent thereon. In FIG. 3, there is also illustrated an alternative heating embodiment of the type which heats the fuser roll or fuser member externally. A radiant heat source 76 such as a quartz lamp surrounded by heat shield 74 is mounted in such a way that it provides sufficient thermal energy on the surface of fuser roll 3 to fuse the toner images to the support sheets (not shown). In FIG. 3, the solid portion of the heated roll is designated by numeral 72 and represents the solid, abrasion resistant material such as polyimide, polyamide imide, polyimide ester, aromatic polyamide and polysulfone. Thus, in the embodiment of FIG. 3, the base member or core 72 comprises the same material as layer 64 coated upon core 4 in FIG. 2. In FIG. 3, the solid, abrasion resistant material whether it is a polyimide, polyamide-imide, polyimide ester, aromatic polyamide or polysulfone or any mixture of the foregoing, may be mounted upon a suitable shaft for rotation. A release layer of the polysiloxane fluid containing fluorocarbon is designated by numeral 70. Thus, there is described a fuser member having a solid substrate 72 made of a material such as polyimide, polyamide-imide, polyimide ester, aromatic polyamide or polysulfone or mixtures thereof and a release layer of polysiloxane fluid containing fluorocarbon, 70, which is abhesive to electroscopic toner.

In accordance with the present invention, the working surface of the fuser member comprises a solid, abrasion resistant material selected from the group consisting of polyimide, poly (amide-imide), polyimide esters, aromatic polyamides and polysulfone and mixtures thereof. The foregoing materials are relatively low surface energy materials, however, it has been found that the foregoing materials when used as the surface of a fuser member, must have a thin layer of polysiloxane fluid containing fluorocarbon metered or coated thereon in order to prevent hot toner material from wetting the surface of the fuser member and sticking thereto thereby causing the problem of offsetting which is well known in the art. When the abrasion resistant materials are used in conjunction with the polysiloxane fluids containing fluorocarbons, there is provided a surface which releases toner material and prevents offsetting of the toner, especially heated or molten toner.

The polymer release materials or release agents which are used in the present invention are polysiloxane fluids containing fluorocarbon materials. The polysiloxane fluids of the present invention have a siloxane backbone of the general formula

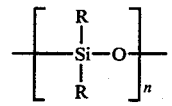

where n is an appropriate number such that the siloxane assumes a fluid state (liquid) at operating termperatures which are generally from about 200° F. (93° C.) to about 450° F. (232° C.); and where R is alkyl, substituted alkyl, aryl, substituted aryl, mixtures or blends thereof, and the like. In one of the most preferred embodiments, R is methyl ($—CH_3$). In certain instances, R may be a functional group such as those described in U.S. Pat. 4,029,827. R may also be halogen such as chlorine, carboxylic, mercapto, epoxy, thio, amino, and in preferred embodiments, any one or a mixture of the foregoing R groups may be substituted on the siloxane backbone having R groups which are alkyl groups, aryl groups or substituted alkyl or aryl groups or mixtures thereof.

Exemplary of the polysiloxane fluids which may be used in the release agents or materials of the present invention are those siloxanes having the foregoing general formula wherein all R constituents are alkyl groups having one or more carbon atoms and mixtures thereof, and when all R groups are methyl, the polysiloxane fluid is known as polydimethyl siloxane or conventional silicone oil. However, one or more of the R groups in the molecule may be an aryl group, for example phenyl, or it may be a halogen group, for example, chlorine, or it may be a mercapto group, an amino group, an epoxy group, a thio group, a carboxylic group or other functional group, or it may be a halogen, mercapto, amino, epoxy, thio, carboxylic, or other functional-group, substituted alkyl or mixtures thereof. Thus, one R group in the molecule may be a mercapto-propyl group ($HS—CH_2CH_2CH_2—$) and the remaining R groups may be methyl groups. All R's in the molecule may be the same, or they may be mixtures of groups such as those specified above. The polysiloxane fluids may also encompass those siloxanes having substituted non-reactive inorganic substituents substituted on the silicon atom. The molecular weight of the particular polysiloxane material is not critical so long as the polysiloxane is liquid at operating temperatures.

The release agents of the present invention are a mixture or a blend of a polysiloxane fluid and a fluorocarbon material, such as a low molecular weight fluorocarbon. Although in preferred embodiments, the fluorocarbon material is in the form of solid, finely-divided particles of the fluorocarbon dispersed in the polysiloxane fluid, the fluorocarbon material may also be a liquid which is substantially miscible with the polysiloxane fluid, or it may be a liquid which is substantially immiscible with the polysiloxane fluid. The viscosity of the release agent mixture or blend is not critical, and generally the viscosity may range from about 30 centistokes to about 2000 centistokes (measured at 25° C.).

Many well known fluorocarbons may be used in accordance with the present invention. These include polytetrafluoroethylene, polyhexafluoropropylene, fluorinated ethylene-propylene polymer, tetrafluoroethylene/hexafluoropropylene copolymer, fluorocarbon telomer, and mixtures thereof. In preferred embodiments, these materials are low molecular weight and include fluorocarbons having a molecular weight within the range of about 200 to 100,000. As indicated above, and depending upon the particular fluorocarbon polymer, the fluorocarbon material may be a solid powder blended or mixed with the polysiloxane fluid, or it may be a liquid dispersed in the polysiloxane fluid or dissolved in the polysiloxane fluid.

Typical fluorocarbons having a molecular weight from about 200 to about 100,000, include polytetrafluoroethylene (PTFE) or (TFE) of the general formula $(C_2F_4)_n$ and being essentially in the form of a powder or an aqueous dispersion. Several forms supplied by E. I. duPont under the trade designation, Teflon, may be used in the polysiloxane fluid in accordance with the present invention. Another typical fluorocarbon is fluorinated ethylene-propylene polymer available in the form of powders and aqueous dispersions. Tetrafluoroethylene/hexafluoropropylene copolymers are also available in the form of powders and are described in U.S. Pat. No. 3,661,831. Fluorocarbon-telomers may also be blended or mixed with the polysiloxane fluids to form the release agents useful in the present invention. Exemplary of fluorocarbon telomers is the material supplied by E. I. duPont Co. under the trade designation Vydax. Commonly used forms of Vydax include dispersions and solid powders. As with all of the fluorocarbon polymers, the blend or mixture with polysiloxane fluid may be made by stirring, mixing or otherwise dispersing the fluorocarbon polymer in the polysiloxane fluid. Particularly useful fluorocarbon telomers are those designated by such trade designations as Vydax 1000, Vydax BR and Vydax 78U supplied by E. I. duPont Co.

The release agents of the present invention are applied to the surface of the fuser member in any thickness which will prevent the offsetting of the toner to the surface of the fuser member. In preferred embodiments, the thickness of the release agent on the fuser member surface is about 0.5 to about 10 microns. The release agent may be applied continuously or it may be applied intermittently as required.

Generally the release agent of the present invention comprises from about 1.0 weight percent to about 80.0 weight percent of the fluorocarbon polymer and more preferably, from about 5.0 weight percent to about 20.0 weight percent of the fluorocarbon polymer (based upon the weight of the polysiloxane fluid).

The surface of the fuser member comprises a solid, abrasion resistant material selected from the group consisting of polyimide, polyamide imide, polyimide ester, aromatic polyamide and polysulfone. Any one or a combination of the foregoing materials may be used as the surface material of the fuser member. In certain instances, the entire fuser member may be made of the solid, abrasion resistant material, however, in preferred embodiments, the solid, abrasion resistant material is coated upon the surface of a core or base member. In such instances where the solid, abrasion resistant material is coated upon a base member or core through which thermal energy must be transferred, it is preferred that the final thickness of the coating or layer upon the surface of the fuser member be about 0.5 to about 10 mils and more preferably from about 0.8 to about 2.0 mils in thickness. The materials may be applied to the base member or core by any well known techniques including the spraying of the material from a dispersion or solution thereof and including any number of applications thereof. Sleeves of the materials may also be applied to the base member or core.

In accordance with the present invention, it is critical that the solid, abrasion resistant surface materials be selected from the group consisting of polyimide, polyamide-imide, polyimide ester, aromatic polyamide and polysulfone or mixtures thereof. These materials may also be applied to a core or base member by extrusion or other hot melt applications upon the surfaces.

Polysulfone is a synthetic thermoplastic polymer which is made from the condensation of bis-phenol A and dichlorophenyl sulfone. Polysulfone is supplied by Union Carbide Corporation under the tradename Udel.

Aromatic polyamides are produced by a polycondensation reaction of an aromatic dicarboxylic acid and an aromatic diamine. Aromatic polyamides are supplied by duPont Corporation under the tradename of KS resins.

Polyester-imides are produced by reacting aromatic diamines with dianhydride containing ester links in the central chain. Polyester-imides are supplied by General Electric Co. under the tradename of Imidex E and by Schenectady Chemical Co. under the tradename of Isomid. As used herein polyester-imide and polyimide ester may be used interchangeably.

Poly amide-imides are produced by reacting an aromatic acid anhydride to form a polyamic acid which is converted to the polyamide through the action of heat. Polyamide-imides are supplied by Amoco Chemical Corporation under the tradename of Torlon.

Polyimides are produced by the two-step reaction of aromatic dianhydride with aromatic primary diamines. A polyamic acid formed in the first step is subsequently converted by heat or catalyst to a high molecular weight polyimide. Polyimides are produced by several suppliers including duPont (Pyralin), Monsanto Co. Skygard 700) and Upjohn Co. (Polyimide 2020).

A class of preferred polyimides are polymers derived from pyromellitic dianhydride and an aromatic diamine with the basic structural unit $$[-N(CO)_2C_6H_2(CO)_2NC_6H_4OC_6H_4-]_n.$$

The following examples further define and describe exemplary materials for preventing toner offset when fusing toner images to a substrate on a heated fuser member having solid, abrasion resistant surface materials thereon.

In determining the effectiveness of the polysiloxane fluids having fluorocarbon polymers therein, electrostatic latent images are formed on a conventional recording surface in a conventional electrostatic reproducing apparatus described earlier in the specification. The electrostatic latent image is developed with a heat fusible toner comprising carbon black pigmented copolymer, styrene-n-butyl methacrylate (Xerox Corporation 364 toner), a trade designation of Xerox Corporation, the toner particles being held on the recording surface in conformance with the electrostatic latent image. The toner image is thereafter transferred to plain paper. The paper having the toner images electrostatically adhered thereto is then passed at a speed of about 15 inches (38.1 cm.) per second between a fuser roll structure and a backup roll, the fuser roll structure being the type wherein temperature can be controlled as well as nip pressure. The toner image contacts the fuser roll structure which has a 2.0 inch (5.0 cm.) outside diameter and is 4 inches (10.2 cm.) long. The fuser roll is coated with a solid, abrasion resistant surface material of about 1.0 mil (0.0025 cm.) thickness. The backup roll has an outside diameter of about 3.0 inches (7.5 cm.) with a 0.75 inch (1.90 cm.) layer of silicone rubber having a durometer of 40 Shore A covered with a 0.020 inch (0.05 cm.) coating of fluorinated ethylene propylene resin on the surface. The fuser roll is internally heated and is fabrciated from a core of steel having the 1.0 mil (0.0025 cm.) layer of solid, abrasion resistant surface material as designated below adhered thereto. Various release agents as described below are metered onto the fuser roll by means of a doctor blade prior to contacting thereof by the toner image. The plain paper bearing the transferred toner image is then passed through the nip, and the toner image contacts the fuser roll surface having the release agent thereon. Observations are then made for toner offsetting upon the surface of the fuser roll and upon subsequent sheets of paper passed therethrough.

A fuser roll is coated with a 1.0 mil thick layer of polyimide supplied by Monsanto Company under the trade designation Skygard 700. Three release agents having viscosities respectively of 50, 100 and 1000 centistokes at 25° C. are metered onto the fuser roll. The release agents are made by mixing ten percent by weight of a powdered tetrafluoroethylene supplied by E. I. duPont Co. under the trade designation Teflon until the polytetrafluoroethylene is completely dispersed in silicone oil supplied by Dow Corning Corporation under the trade designation Dow Corning 200 Fluid. No toner offset is observed when the toner image is fused to the paper at a temperature of about 400° F. (204° C.).

A fuser roll is coated with an aromatic polyamide supplied E. I. duPont Co. under the trade designation KS as a resin. A release agent is prepared by mixing a mercapto-functional polyorganosiloxane of the type described in U.S. Pat. No. 4,029,827 with a fluorocarbon telomer supplied by E. I. duPont Co. under the trade designation Vydax 1000. The blended release agent is applied to the fuser roll and no toner offset is observed when toner images upon a paper support are fused at a temperature of about 400° F. (204° C.). The release agent comprises 90 percent by weight of the mercapto-functional polyorganosiloxane and 10 percent by weight of the fluorocarbon telomer.

While the invention has been described with respect to preferred embodiments, it will be apparent that certain modifications and changes can be made without departing from the spirit and scope of the invention, and therefore, it is intended that the foregoing disclosure be limited only by the claims appended hereto.

What is claimed is:

1. A method for fusing a toner image to a support sheet comprising contacting the support sheet bearing the toner image with the surface of a solid, abrasion resistant material selected from the group consisting of polyamide-imide, polyimide ester, aromatic polyamide and polysulfone, for a time and at a temperature sufficient to permit heating and fusion of the toner image to the support sheet; the surface of the abrasion resistant material having a thin layer of a release agent comprising a mixture of a polysiloxane fluid and fluorocarbon polymer thereon; and separating the support from the surface of the abrasion resistant material whereby the heated toner separates from the surface of the abrasion resistant material.

2. The method of claim 1 wherein said fluorocarbon polymer is selected from the group consisting of polytetrafluoroethylene, polyhexafluoropropylene, fluorinated ethylene-propylene polymer, tetrafluoroethylene/hexafluoropropylene copolymer, fluorocarbon telomer, and mixtures thereof.

3. The method of claim 2 wherein the polysiloxane fluid is a silicone oil.

4. The method of claim 3 wherein the silicone oil is polydimethylsiloxane.

5. The method of claim 3 wherein the silicone oil is a polyalkylsiloxane having functional groups thereon.

6. The method of claim 1 wherein the thickness of the release agent on the fuser member is about 0.5 to about 10 microns.

7. The method of claim 1 comprising continuously applying the release agent to the surface of the abrasion resistant material.

8. The method of claim 1 wherein the release agent comprises from about 1.0 weight percent to about 80.0 weight percent of the fluorocarbon polymer.

9. The method of claim 1 wherein the release agent comprises from about 5.0 weight percent to about 20.0 weight percent of the fluorocarbon polymer.

10. The method of claim 1 wherein the fluorocarbon polymer is a solid dispersed in the polysiloxane fluid.

11. The method of claim 1 wherein the fluorocarbon polymer is a liquid substantially miscible with the polysiloxane fluid.

12. The method of claim 1 wherein the fluorocarbon polymer is a liquid substantially immiscible with the polysiloxane fluid.

13. A method of preventing toner offset when fusing toner images to a substrate with a heated fuser member having a solid, abrasion resistant surface material selected from the group consisting of polyamide-imide, polyimide ester, aromatic polyamide and polysulfone comprising (a) coating the surface of the heated fuser member in an electrostatic reproducing apparatus with a release agent comprising a mixture of a silicone oil and fluorocarbon polymer;

(b) contacting the toner images on the substrate for a period of time sufficient to soften the toner; and (c) allowing the toner to cool.

14. The method of claim 13 wherein said fluorocarbon polymer is selected from the group consisting of polytetrafluoroethylene, polyhexafluoropropylene, fluorinated ethylene-propylene polymer, tetrafluoroethylene/hexafluoropropylene copolymer, fluorocarbon telomer and mixtures thereof.

15. The method of claim 13 wherein the thickness of the release agent is about 0.5 to about 10 microns.

* * * * *